US007300337B1

(12) United States Patent
Sun et al.

(10) Patent No.: US 7,300,337 B1
(45) Date of Patent: Nov. 27, 2007

(54) GRINDING MACHINE WITH A DUST COLLECTOR

(75) Inventors: Yung-yung Sun, Dali (TW); Chuan-ching Cheng, Taichung (TW)

(73) Assignee: Storm Pneumtic Tool Co., Ltd., Taichung County (TW)

( * ) Notice: Subject to any disclaimer, the term of this patent is extended or adjusted under 35 U.S.C. 154(b) by 0 days.

(21) Appl. No.: 11/585,894

(22) Filed: Oct. 25, 2006

(51) Int. Cl.
*B24B 23/00* (2006.01)

(52) U.S. Cl. ..... 451/295; 451/456; 451/358

(58) Field of Classification Search ..... 451/358, 451/359, 456, 295
See application file for complete search history.

(56) References Cited

U.S. PATENT DOCUMENTS 2,349,156 A * 5/1944 Fischer ..... 408/56
3,785,092 A * 1/1974 Hutchins ..... 451/357
4,296,572 A * 10/1981 Quintana ..... 451/356
7,115,028 B1 * 10/2006 Chen ..... 451/360

* cited by examiner

*Primary Examiner*—Robert A. Rose
(74) *Attorney, Agent, or Firm*—Rosenberg, Klein & Lee

(57) ABSTRACT

A grinding machine with a dust collector includes a driving portion, a transmitting portion, a dust-collecting tube, a fender, an air intake connector and a grinding wheel. The dust produced by the rotation of the grinding wheel is sucked by the dust-collecting tube having an inner tube. The inner tube is interconnected with an exhaust vent of the driving portion and the dust-discharging opening. An outlet of the inner tube is parallel to an airflow passage of the dust-discharging opening, such that when an exhaust gas is discharged from the inner tube, a siphon effect is produced at the airflow passage of the dust-collecting tube to suck and collect the dusts produced by the grinding wheel.

6 Claims, 7 Drawing Sheets

GRINDING MACHINE WITH A DUST COLLECTOR

BACKGROUND OF THE INVENTION

1. Field of the Invention

The present invention relates to a grinding machine, and more particularly to a grinding machine having a dust-collecting tube with an inner tube, and the inner tube is interconnected with an exhaust vent and the dust-collecting tube to produce a siphon effect for collecting dust.

2. Description of the Related Art

Referring to FIG. 6 for a traditional grinding machine, the grinding machine includes a driving portion 9 and a transmitting portion 8, and an end of the driving portion 9 has an air inlet 91 and an exhaust vent 92, and an end of the transmitting portion 8 has a grinding wheel 81, such that when air is introduced into the air inlet 91, the driving portion 9 is driven to rotate the grinding wheel 81, and air is discharged from the exhaust vent 92.

However, the aforementioned grinding machine usually produces a large quantity of dusts during the grinding process, and users may inhale lots of dusts into their lungs, and the dust contamination always causes tremendous inconvenience to the work.

Referring to FIG. 7 for another common grinding machine, the difference between this grinding machine and the foregoing grinding machine resides on that the bottom of this grinding machine includes a dust-collecting tube 7; wherein an end of the dust-collecting tube 7 has a dust-discharging opening 71, and another end of the dust-collecting tube 7 has a dust-collecting opening 72, and the dust-collecting opening 72 is situated at a working area of the grinding wheel 81. During a grinding operation, a power dust collector S is used to suck the dusts produced by the grinding wheel, and thus users need to purchase a power dust collector (such as a vacuum cleaner).

Sometimes, there is a need to remove or replace a grinding wheel 81 disposed on a lateral side of the grinding machine, but there is no protection by a fender, and users may get injured easily if the users do not hold the grinding machine firmly and steadily.

SUMMARY OF THE INVENTION

Therefore, it is a primary objective of the present invention to overcome the foregoing shortcomings by providing a grinding machine with a dust collector that installs a dust-collecting tube having an inner tube, and an outlet of the inner tube is parallel to a dust-discharging opening of the dust-collecting tube, and the inner tube is provided for guiding exhaust gas from an exhaust vent to the dust-discharging opening and discharging the exhaust gas to the outside, such that a siphon effect produced at the airflow passage of the dust-collecting tube can absorb a large quantity of dusts produced by a grinding wheel.

The secondary objective of the present invention is to provide a grinding machine that installs an easily installable and removable fender on a side of a working area of the grinding machine for providing a safer operating environment to users and reducing possible working injuries caused by negligence or carelessness.

To achieve the foregoing objectives, the present invention comprises: a driving portion, having an air inlet and an exhaust vent, and both disposed at an end of the driving portion; a transmitting portion, disposed at an end of the driving portion, and an end of the transmitting portion away from the driving portion having a driving shaft, for driving a grinding wheel to rotate, and a working area enclosed by the grinding wheel; and a dust-collecting tube, with an end as a dust-collecting opening connected to the working area, and another end as a dust-discharging opening, such that an airflow passage is formed between the dust-collecting opening and the dust-discharging opening, and a penetrating hole of the dust-discharging opening is interconnected with the exhaust vent, and the penetrating hole is connected to an inner tube having an outlet disposed in the airflow passage, and the outlet and the dust-discharging opening are aligned in the same direction.

DETAILED DESCRIPTION OF THE PREFERRED EMBODIMENTS

Referring to FIGS. 1 to 5 for a structure of a preferred embodiment of the present invention, the preferred embodiment is provided for illustrations, and the present invention is not intended to be limited to such structure only.

Figure 1:
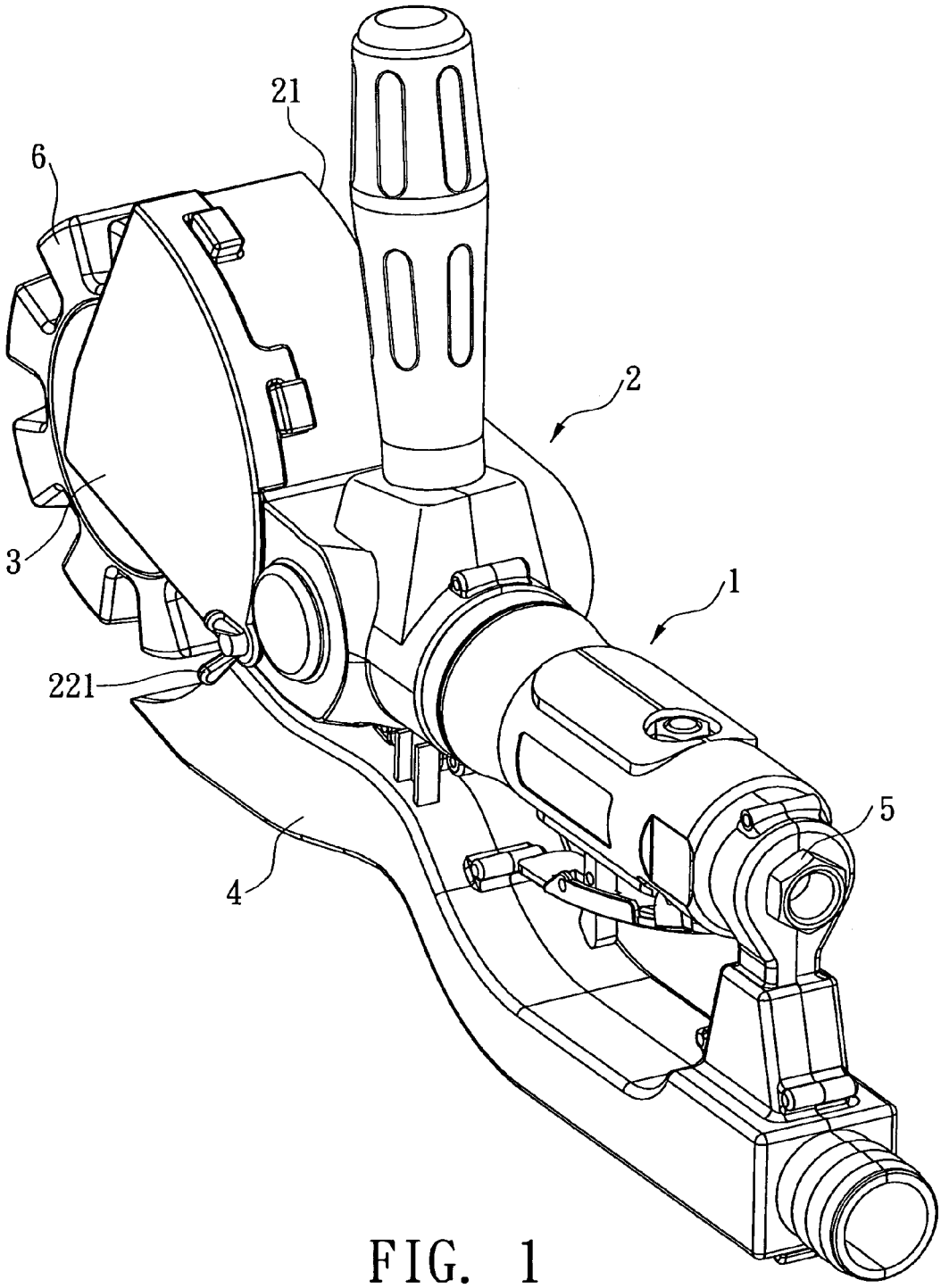
FIG. 1 is a perspective view of the present invention.
Figure 2:
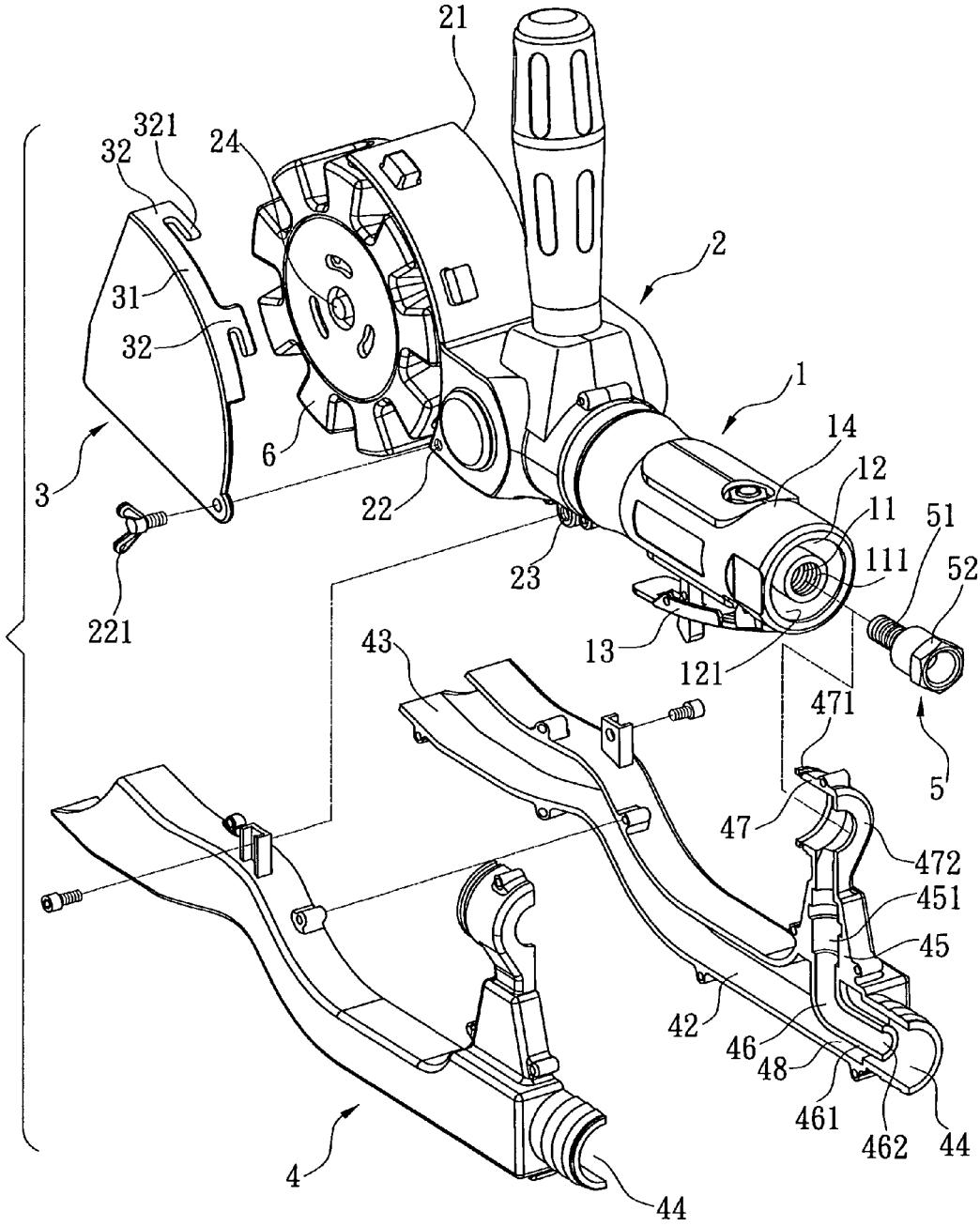
FIG. 2 is an exploded view of the present invention.

Referring to FIGS. 1 and 2 for a preferred embodiment of the invention, a grinding machine with a dust collector of the invention comprises a driving portion 1, a transmitting portion 2, a second fender 3, a dust-collecting tube 4, and an air intake connector 5.

An end of the driving portion 1 is coupled to the transmitting portion 2, and another end of the driving portion 1 is installed with the air intake connector 5. The transmitting portion 2 has a first fender 21 and a second fender 3 mounted on the transmitting portion 2, and a grinding wheel 6 is installed between the fenders 21, 3.

An end of the driving portion 1 has an air inlet 11, and the air inlet 11 contains an internal screw thread portion 111. The external periphery of the air inlet 11 has an exhaust vent 12, and the external side of the exhaust vent 12 has a receiving portion 121. Further, the bottom of the driving portion 1 has a press switch 13, and the external periphery of the driving portion 13 is a hand holding portion 14.

A lateral side of the bottom of the transmitting portion 2 has a first fixing portion 22 (which is a screw hole in this embodiment) for installing a fixing element 221 (which is a wing head screw in this embodiment); the bottom of the transmitting portion 2 has two symmetrical second fixing portions 23 (which are screw holes in this embodiment) for fixing the dust-collecting tube 4. An end of the transmitting portion 2 has a driving shaft 24 perpendicular to the driving portion 2 for driving the grinding wheel 6 to rotate.

Figure 3:
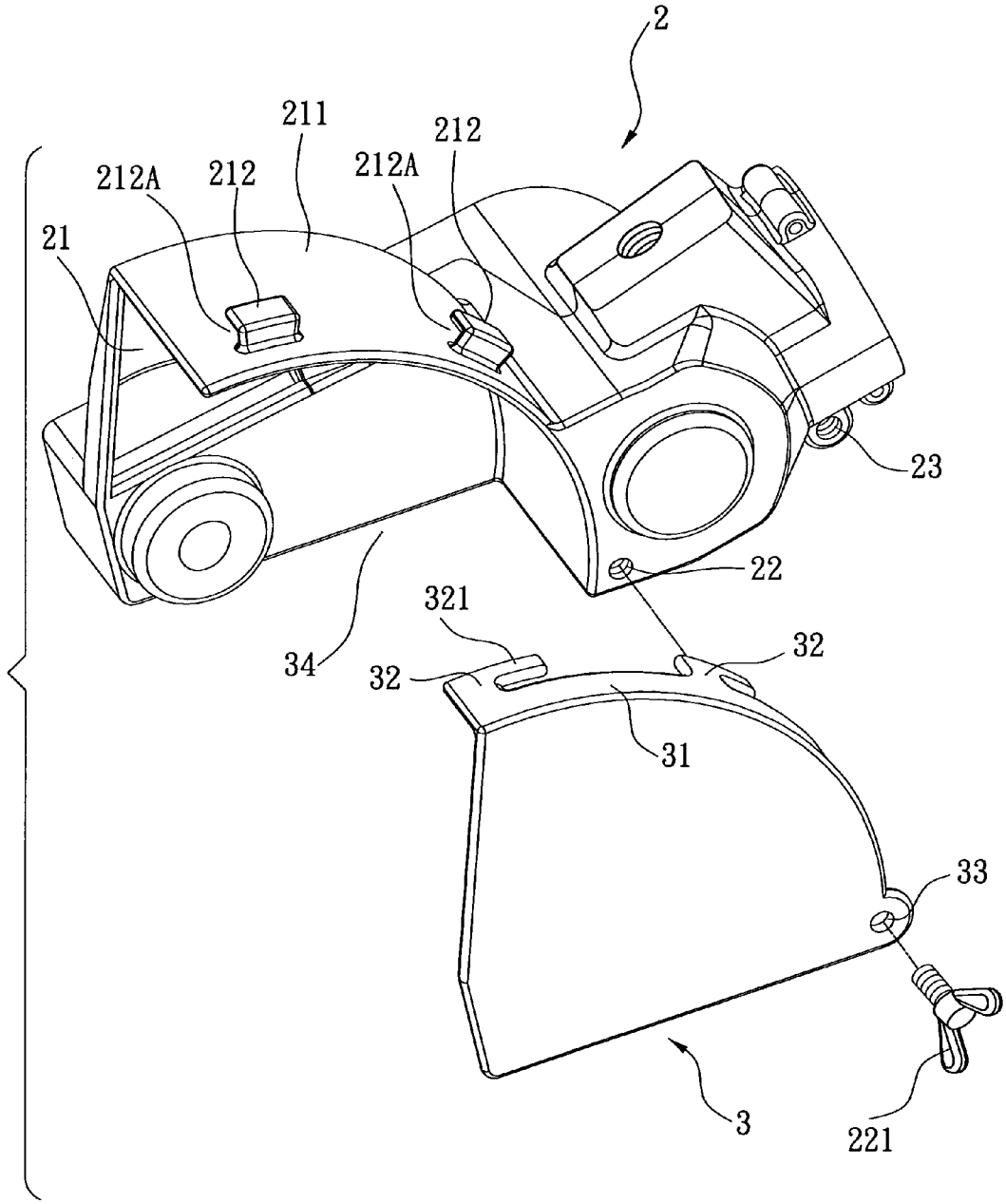
FIG. 3 is a schematic view of combining a first fender and a second fender in accordance with the present invention.

The transmitting portion 2 has a first fender 21 as shown in FIG. 3, and the first fender 21 has an arc portion 211, and the external side of the arc portion 211 has at least one first latch portion 212, and the first latch portion 212 has a recession 212A for installing the second fender 3.

The second fender 3 is substantially in the shape of a sector, and the circumference of the second fender 3 has an extended section 31, and the extended section 31 has at least one second latch portion 32, and the second latch portion 32 has a protrusion 321 extended and latched into the recession 212A. A lateral side of the second fender 3 has a through hole 33 for passing the fixing element 221 and fixing it to the first fixing portion 22; and a working area 34 enclosed by the first fender 21 and the second fender 3 is formed at a surrounding area of the grinding wheel 6.

Figure 4:
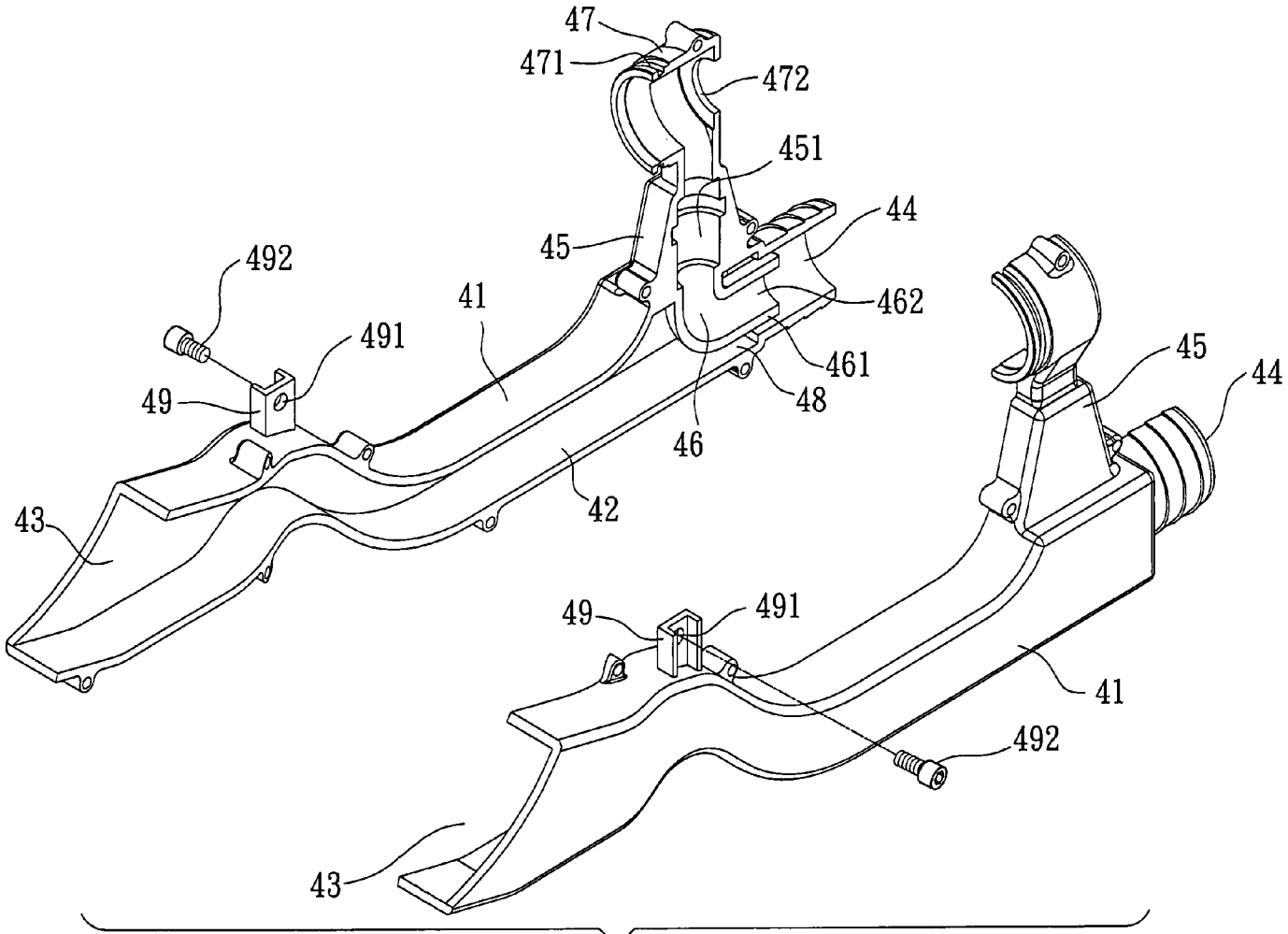
FIG. 4 is an exploded view of a dust-collecting tube of the present invention.

Referring to FIG. 4, an end of the dust-collecting tube 4 has a dust-collecting opening 43 interconnected to the working area 34, and another end is a dust-discharging opening 44. The dust-collecting tube 4 is composed of two symmetrical casings 41, and an airflow passage 42 is formed between the dust-collecting opening 43 and the dust-discharging opening 44 for discharging dusts. The dust-collecting tube 4 has a first connecting portion 45, and the first connecting portion 45 has an axial penetrating hole 451, and the penetrating hole 451 is extended into the airflow passage 42 and has a parallel section 461 to constitute an L-shape inner tube 46. The inner tube 46 has an outlet 462, and the outlet 462 and the dust-discharging opening 44 are aligned in the same direction. The first connecting portion 45 has a hollow circular shell 47 extended upward, and an end of the circular shell 47 has an installing portion 471, and another end of the circular shell 47 has a hollow circular wall 472, such that when the air intake connector 5 is installed, the air intake connector guides exhaust gas to be discharged from the exhaust vent 12 through the inner tube 46, and a siphon effect area 48 is produced at the outlet of the inner tube 46.

The dust-collecting tube 4 has two symmetric second connecting portions 49, and the second connecting portion 49 has a penetrating hole 491 for installing a fixing element 492 (which is a hexagonal screw in this embodiment) for mounting the second connecting portions 49 to the second fixing portion 23 of the transmitting portion 2.

Referring to FIG. 2, the air intake connector 5 is substantially in a tubular shape, and the external periphery of the air intake connector 5 has an external screw thread portion 51. The air intake connector 5 has a stopping portion 52 for stopping a circular wall 472 of the dust-collecting tube 4 and fixing the dust-collecting tube 4 at the driving portion 1. If the air intake connector 5 is installed, the external screw thread portion 51 of the air intake connector 5 is locked at an internal screw thread portion 111 of the driving portion 1, and the installing portion 471 disposed on the circular shell 47 is coupled to a receiving portion 121 of the driving portion 1.

Figure 5:
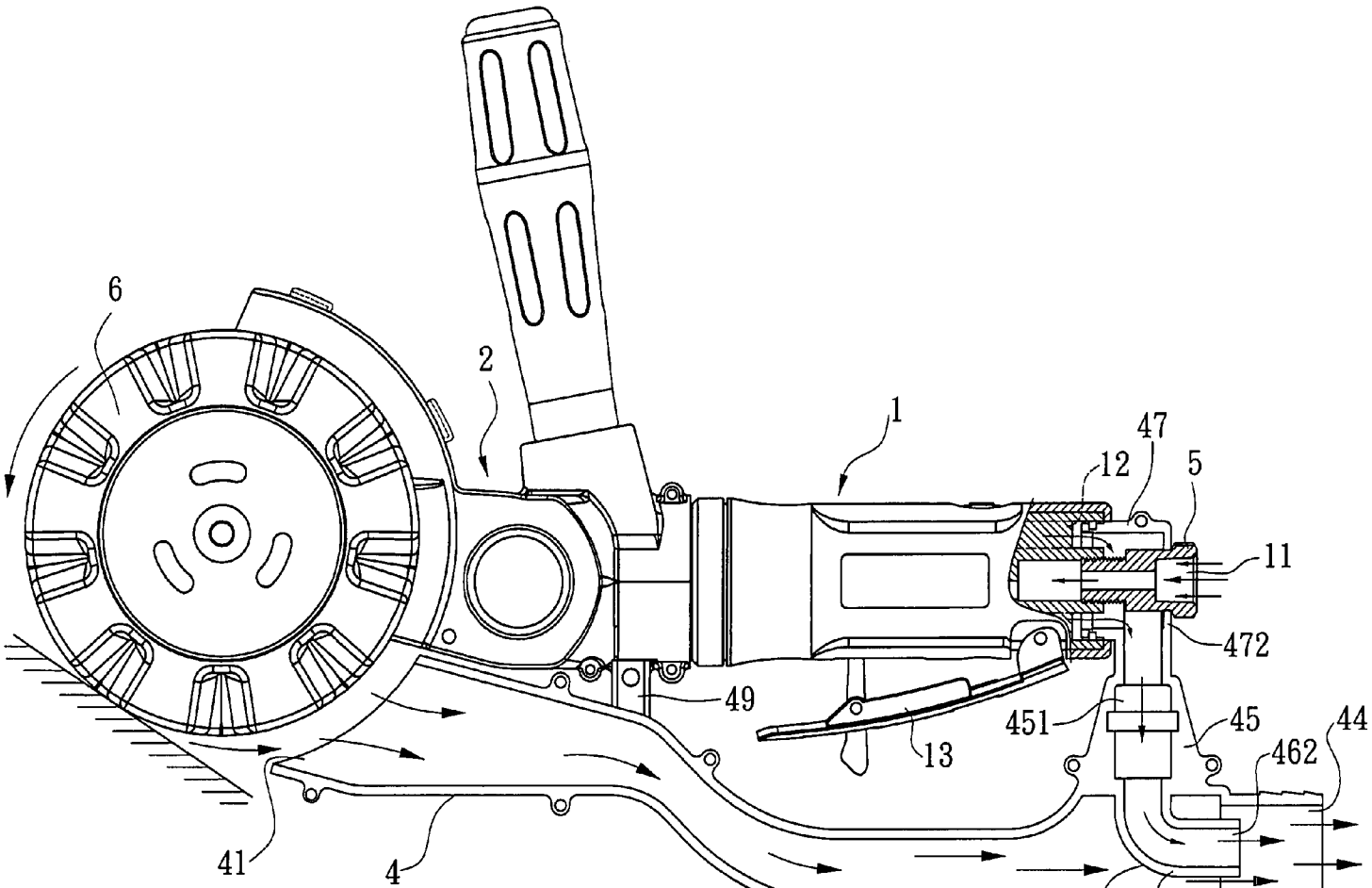
FIG. 5 is a schematic view of a siphon phenomenon of a dust-collecting tube of the present invention.
Figure 6:
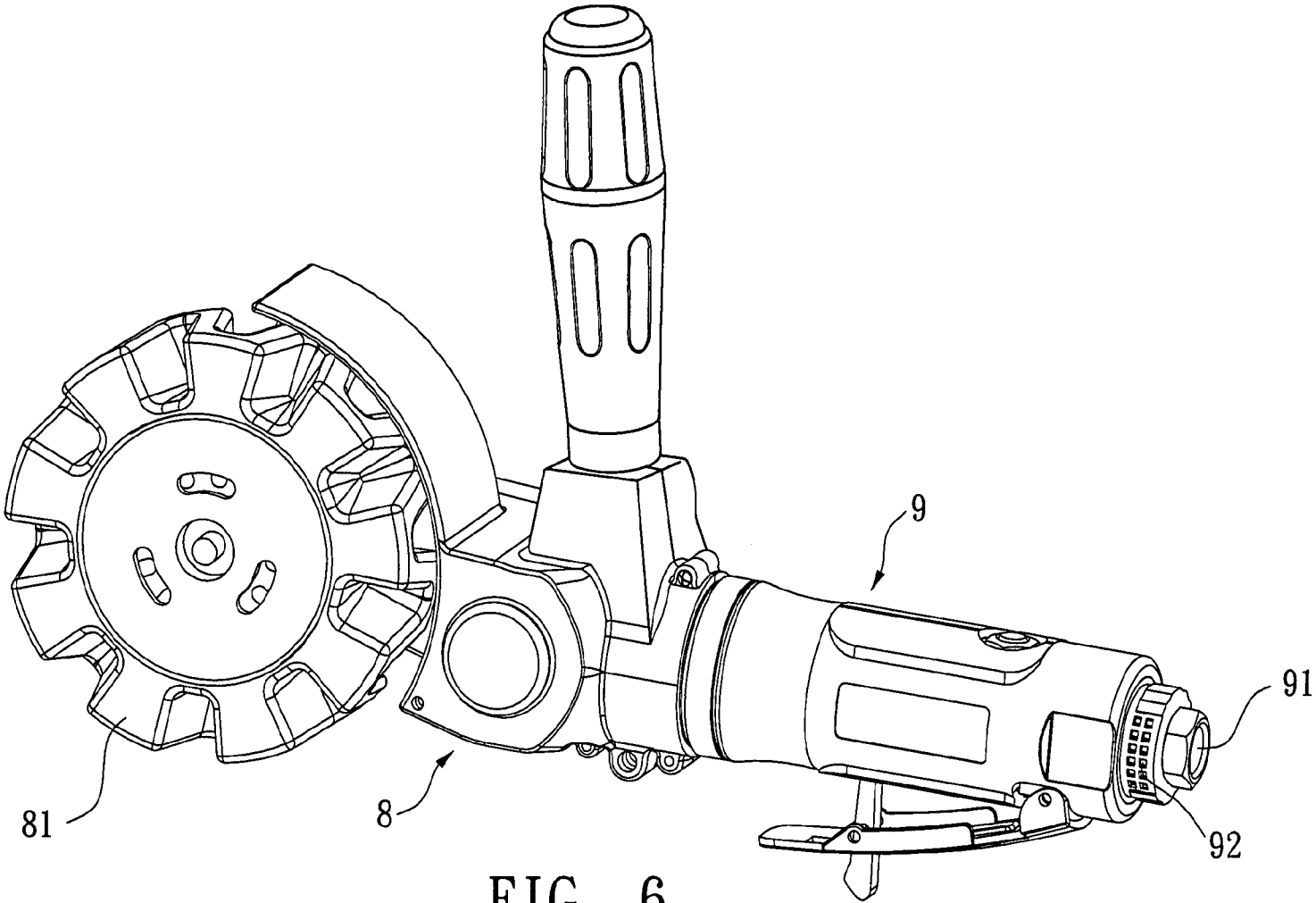
FIG. 6 PRIOR ART
FIG. 6 is a perspective view of a prior art grinding machine.
Figure 7:
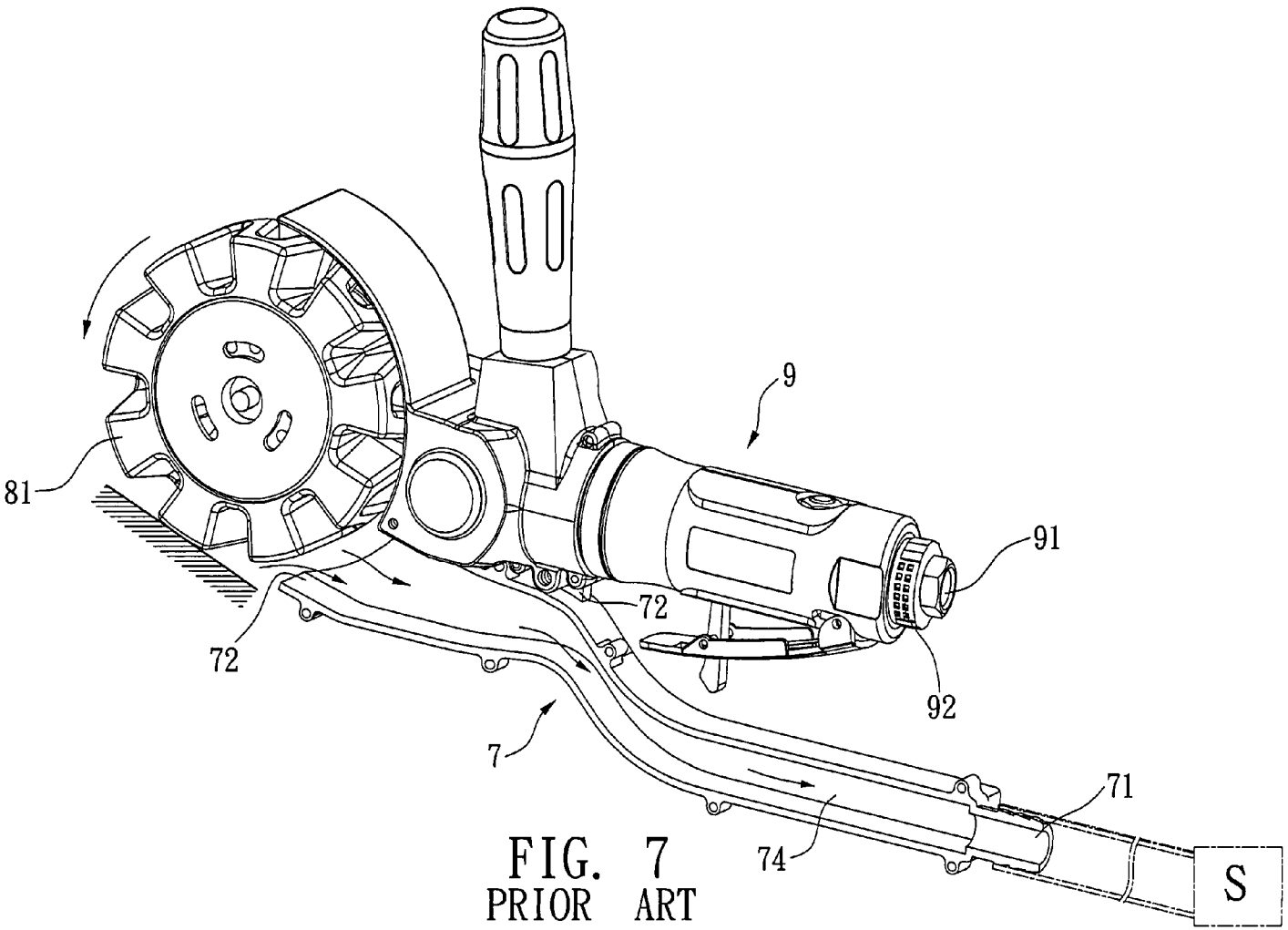
FIG. 7 PRIOR ART
FIG. 7 is a schematic view of a dust-collecting tube and the air discharging of the dust-collecting tube in accordance with another prior art grinding machine.

If the air intake connector 5 is connected to an air pressure source, air provided by the air pressure source is transmitted to the driving shaft 24 for rotating the grinding wheel 6 by pressing a press switch 13 as shown in FIG. 5.

Therefore, the exhaust gas discharged from the exhaust vent 12 of the driving portion 1 is guided to flow and discharge from the circular shell 47 to the outside through the inner tube 46. Of course, the air discharged from the inner tube 46 produces a siphon effect at the siphon effect area 48 of the airflow passage 42 to drive the airflow in the airflow passage 42 and carry a large quantity of dusts produced by the grinding wheel 6 away from the working area 34, and then the dusts from the dust-collecting tube 4 can be discharged to the outside. Further, the dust-discharging opening 44 can be connected to a dust storage device (such as a bag made of unwoven cloth, which is not shown in the figure) that requires no electric power for collecting the dust.

What is claimed is:

1. A grinding machine with a dust collector, comprising:

a driving portion, having an air inlet and an exhaust vent, both disposed at an end of said driving portion;

a transmitting portion, disposed at an end of said driving portion, and an end of said transmitting portion away from an end of said driving portion having a driving shaft, for driving a grinding wheel to rotate, and said grinding wheel defining a working area enclosed by said grinding wheel, said transmitting portion having a first fender, said first fender having an arc portion, said arc portion having (a) a second fender, and (b) at least one first latch portion extended from a side thereof, said first latch portion having a recession for installing said second fender, said second fender having an extended section, said extended section having at least one second latch portion, said second latch portion having a protrusion extendable into said recession, and said second fender having a through hole disposed on a side thereof for passing a fixing element; and a dust-collecting tube, with an end as a dust-collecting opening interconnected to said working area, and another end as a dust-discharging opening, and forming an airflow passage between said dust-collecting opening and said dust-discharging opening, and said dust-discharging opening being interconnected with said exhaust vent through a penetrating hole, and said penetrating hole being interconnected with an inner tube, and said inner tube having an outlet situated in said airflow passage, and said outlet and said dust-discharging opening being aligned in the same direction.

2. The grinding machine with a dust collector of claim 1, wherein said air inlet has an internal screw thread portion, and said exhaust vent has a receiving portion, for installing said dust-collecting tube.

3. The grinding machine with a dust collector of claim 1, wherein said transmitting portion has a first fixing portion for installing a fixing element, and said transmitting portion has two symmetrical second fixing portions for fixing said dust-collecting tube.

4. A grinding machine with a dust collector, comprising:

a driving portion, having an air inlet and an exhaust vent, both disposed at an end of said driving portion;

a transmitting portion, disposed at an end of said driving portion, and an end of said transmitting portion away from an end of said driving portion having a driving shaft, for driving a grinding wheel to rotate, and said grinding wheel defining a working area enclosed by said grinding wheel; and a dust-collecting tube, with an end as a dust-collecting opening interconnected to said working area, and another end as a dust-discharging opening, and forming an airflow passage between said dust-collecting opening and said dust-discharging opening, and said dust-discharging opening being interconnected with said exhaust vent through a penetrating hole, and said penetrating hole being interconnected with an inner tube, and said inner tube having an outlet situated in said airflow passage, and said outlet and said dust-discharging opening being aligned in the same direction, said dust-collecting tube being comprised of two symmetric casings and having a first connecting portion, said penetrating hole being penetrated through said first connecting portion, said first connecting portion having a hollow circular shell extended upward from said first connecting portion, and an end of said circular shell has a circular wall and an air intake connector passed therein.

5. The grinding machine with a dust collector of claim 1, wherein said inner tube has a parallel section extended from said inner tube and disposed parallel to an airflow passage of said dust-collecting tube to constitute an L-shape, and said outlet and said dust-discharging opening are aligned in the same direction.

6. A grinding machine with a dust collector, comprising:

a driving portion, having an air inlet and an exhaust vent, both disposed at an end of said driving portion;

a transmitting portion, disposed at an end of said driving portion, and an end of said transmitting portion away from an end of said driving portion having a driving shaft, for driving a grinding wheel to rotate, and said grinding wheel defining a working area enclosed by said grinding wheel; and a dust-collecting tube, with an end as a dust-collecting opening interconnected to said working area, and another end as a dust-discharging opening, and forming an airflow passage between said dust-collecting opening and said dust-discharging opening, and said dust-discharging opening being interconnected with said exhaust vent through a penetrating hole, and said penetrating hole being interconnected with an inner tube, and said inner tube having an outlet situated in said airflow passage, and said outlet and said dust-discharging opening being aligned in the same direction, said air inlet having an air intake connector, an end of said air intake connector having an external screw thread portion, and another end of said air intake connector has a stopping portion protruded thereon and a first connecting portion for stopping said dust-collecting tube.

* * * * *